US006752289B1

(12) United States Patent
Lin

(10) Patent No.: US 6,752,289 B1
(45) Date of Patent: Jun. 22, 2004

(54) LOTTERY TICKET MACHINE

(75) Inventor: Tung-Ying Lin, Taipei (TW)

(73) Assignee: Gamemax Corporation, Taipei (TW)

( * ) Notice: Subject to any disclaimer, the term of this patent is extended or adjusted under 35 U.S.C. 154(b) by 105 days.

(21) Appl. No.: 09/696,291

(22) Filed: Oct. 26, 2000

(51) Int. Cl.[7] ..... G07F 11/72
(52) U.S. Cl. ..... 221/30; 221/26; 225/103
(58) Field of Search ..... 221/30, 31, 26; 225/93, 103, 104, 105, 76, 15

(56) References Cited

U.S. PATENT DOCUMENTS

| | | | | | |
|---|---|---|---|---|---|
| 4,140,259 | A | * | 2/1979 | Kostka et al. | 194/343 |
| 4,202,468 | A | * | 5/1980 | Anderson et al. | 221/268 |
| 4,579,267 | A | * | 4/1986 | Planke | 225/19 |
| 4,635,837 | A | * | 1/1987 | Granger | 225/106 |
| 5,503,318 | A | * | 4/1996 | Chou | 101/66 |
| 5,803,308 | A | * | 9/1998 | Rong | 221/255 |
| 5,833,104 | A | * | 11/1998 | Horniak et al. | 221/197 |
| 5,836,498 | A | * | 11/1998 | Turek | 225/1 |
| 5,950,898 | A | * | 9/1999 | Menna | 225/10 |
| 6,036,052 | A | * | 3/2000 | Tong | 221/255 |
| 6,113,293 | A | * | 9/2000 | Schanke et al. | 101/93.07 |
| 6,322,066 | B1 | * | 11/2001 | Rong | 221/217 |

FOREIGN PATENT DOCUMENTS

JP 10-297814 * 11/1998

JP 2000-194889 * 7/2000

* cited by examiner

*Primary Examiner*—Christopher P. Ellis
*Assistant Examiner*—Patrick Mackey
(74) *Attorney, Agent, or Firm*—Bacon & Thomas, PLLC.

(57) ABSTRACT

A lottery ticket machine includes a base frame, a face panel fixedly fastened to the base frame at a front side, the face panel having a transversely extended ticket slot, a rack fastened to the base frame to hold a serrated plate behind the ticket slot of the face panel, a locating plate fixedly fastened to one lateral side of the base frame, a transverse rod fastened to the locating plate and suspended above the base frame, a pressure plate pivoted to the base frame and adapted to hold down a continuous sheet of lottery tickets being passed from the transverse rod to the ticket slot of the face panel, a control circuit assembly installed in the base frame and controlled to transfer a continuous sheet of lottery tickets from a ticket reel at the transverse rod toward the ticket slot of the face panel, the serrated plate having a serrated edge of substantially M-shaped profile extended along one long side thereof and suspended above the top-most edge of the rack and two protruded portions integral with the serrated edge and spaced from each other at a pitch approximately equal to the width of the continuous sheet of lottery tickets being delivered from the reel at the transverse rod to the ticket slot of the face panel.

5 Claims, 5 Drawing Sheets

LOTTERY TICKET MACHINE

BACKGROUND OF THE INVENTION

The present invention relates to a lottery ticket machine and, more particularly to such a lottery ticket machine, which has a serrated plate with two protruded portions adapted to stretch the continuous sheet of lottery tickets, enabling the lottery tickets to be easily separated one after another.

FIG. 5 shows a lottery ticket machine according to the prior art. According to this design, the driven wheel B1 of the wheel set B is coupled between two side walls A, the gear shaft C11 of the gear C1 of the gear set C is inserted through a hole on one side wall A and the axial center through hole B11 of the driven wheel B1 and then coupled to the other side wall, a shaft D is inserted through the axial center through hole of the drive wheel B2 and coupled between the side walls A, the gear shaft C21 of the second gear C2 of the gear set C is inserted through a hole on one side wall A and the turbine wheel C3 and then coupled to the other side wall A, and the face panel E is fastened to the side walls A at the front side. This structure of lottery ticket machine is still not satisfactory in function. When in use, the continuous sheet of lottery tickets tends to be jammed in the wheel set B.

SUMMARY OF THE INVENTION

The invention has been accomplished to provide a lottery ticket machine, which eliminates the aforesaid problem. According to one aspect of the present invention, the lottery ticket machine comprises a base frame, a face panel fixedly fastened to the base frame at a front side, the face panel having a transversely extended ticket slot, a rack fastened to the base frame to hold a serrated plate behind the ticket slot of the face panel, a locating plate fixedly fastened to one lateral side of the base frame, a transverse rod fastened to the locating plate and suspended above the base frame, a control circuit assembly installed in the base frame and controlled to transfer a continuous sheet of lottery tickets from a ticket reel at the transverse rod toward the ticket slot of the face panel, the serrated plate having a serrated edge of substantially M-shaped profile extended along one long side thereof and suspended above the topmost edge of the rack and two protruded portions integral with the serrated edge and spaced from each other at a pitch approximately equal to the width of the continuous sheet of lottery tickets being delivered from the reel at the transverse rod to the ticket slot of the face panel. According to another aspect of the present invention, a pressure plate is pivoted to the base frame and adapted to hold down the continuous sheet of lottery tickets being delivered from the reel at the transverse rod to the ticket slot of the face panel.

DETAILED DESCRIPTION OF THE PREFERRED EMBODIMENT

Figure 1:
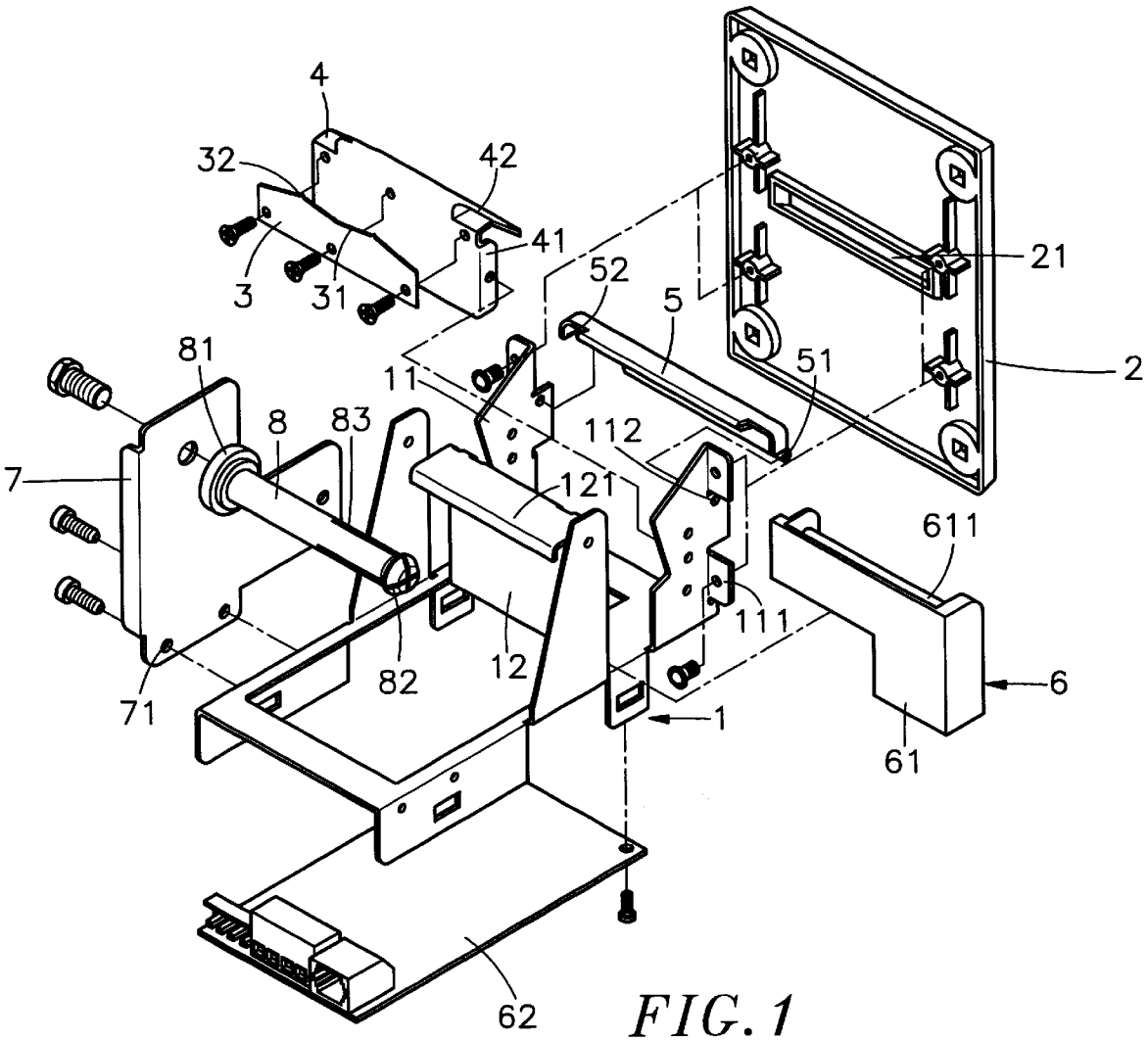
FIG. 1 is an exploded view of a lottery ticket machine according to the present invention.

Referring to FIGS. from 1 through 3, a lottery ticket machine is shown comprised of a base frame 1, a face panel 2, a serrated plate 3, a rack 4, a pressure plate 5, a control circuit assembly 6, a locating plate 7,and a transverse rod 8.

The base frame 1 comprises two upright supports 11 disposed at two opposite lateral sides, and a transverse wall 12 disposed on the middle. Each upright support 11 comprises a pivot hole 112, and transversely extended mounting flanges 111. The transverse wall 12 comprises a guide face 121 horizontally disposed at the topside thereof and adapted to guide movement of a continuous sheet of lottery tickets. The face panel 2 is a flat, rectangular member having a transversely extended ticket slot 21. The serrated plate 3 is a narrow, flat, elongated plate having a serrated edge 31 of substantially M-shaped profile extended along one long side thereof, two protruded portions 32 integral with the serrated edge 31, and a plurality of mounting holes 33 adapted for fastening to the rack 4 by screws. The pitch between the protruded portions 32 is approximately equal to the width of one lottery ticket. The rack 4 comprises two mounting flanges 41 disposed at two distal ends thereof and adapted for fastening to the upright supports 11 of the base frame 1, and a top guide face 42 sloping in one direction. The pressure plate 5 is a curved plate of smoothly arched cross section supported above the upright supports 11 of the base frame 1, having two pivot pins 51 respectively outwardly extended from two distal ends thereof, and two locating flanges 52 respectively extended from the two distal ends at the top side and hooked on the upright supports 11 of the base frame 1. The control circuit assembly 6 is comprised of a gear box 61, and a circuit board 62. The gear box 61 is controlled by the circuit board 62 to rotate a shaft 611 thereof. The locating plate 7 comprises a bottom mounting portion 71 adapted for fastening to one lateral side of the base frame 1 near its rear end. The transverse rod 8 has a fixed end 81 coupled to the locating plate 7, and a split free end 82 adapted for engaging into the axial center hole of the ticket reel (not shown). The split free end 82 has a plurality of longitudinally extended splits 83 so that the split end 82 of the transverse rod 8 can easily be press-fitted into the axial center hole of the ticket reel.

Figure 2:
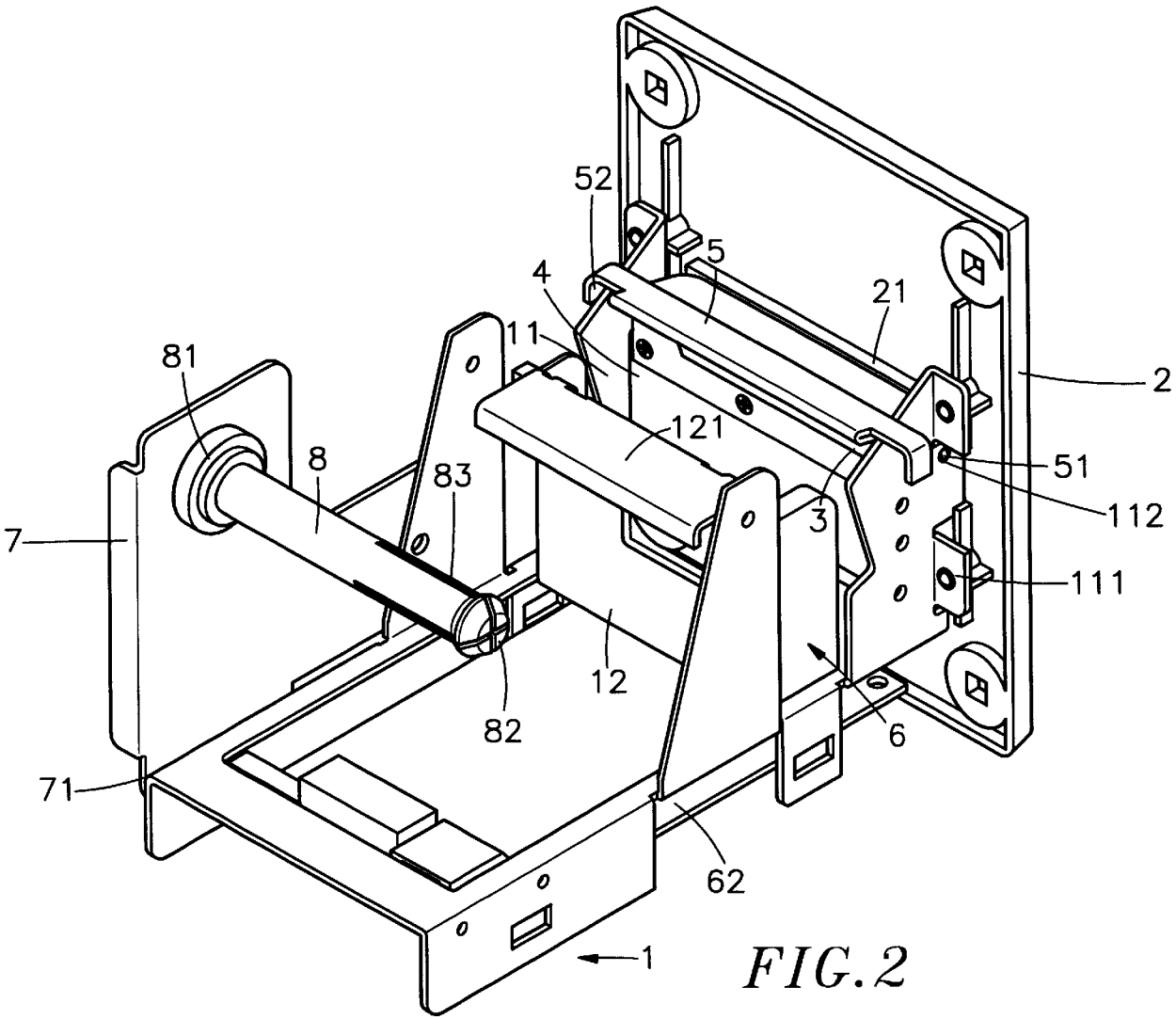
FIG. 2 is an elevational view of the lottery ticket machine according to the present invention.

The assembly process of the present invention is outlined hereinafter with reference to FIGS. 1 and 2 again. The fixed end 81 of the transverse rod 8 is fastened to the locating plate 7, and then the bottom mounting portion 71 of the locating plate 7 is fixedly fastened to one lateral side of the base frame 1, keeping the transverse rod 8 suspended behind the transverse wall 12 of the base frame 1, and then the gear box 61 of the control circuit assembly 6 is fixedly fastened to the transverse wall 12 and the bottom side of the base frame 1, and then the circuit board 62 of the control circuit assembly 6 is fixedly fastened to the bottom side of the base frame 1, and then the mounting holes 33 of the serrated plate 3 are fixedly fastened to the rack 4 by screws, keeping the serrated edge 31 of the serrated plate 3 protruded over the topmost edge of the rack 4, and then the mounting flanges 41 of the rack 4 are respectively fastened to the upright supports 11 of the base frame 1, and then the pivot pins 51 of the pressure plate 5 are respectively coupled to the pivot holes 112 of the upright supports 11, keeping the locating flanges 52 of the pressure plate 5 respectively hooked on the upright supports 11 of the base frame 1, and then the face panel 2 is fixedly fastened to the mounting flanges 111 of the upright supports 11 of the base frame 1, keeping the ticket slot 21 in alignment with the guide face 42 of the rack 4.

Figure 3:
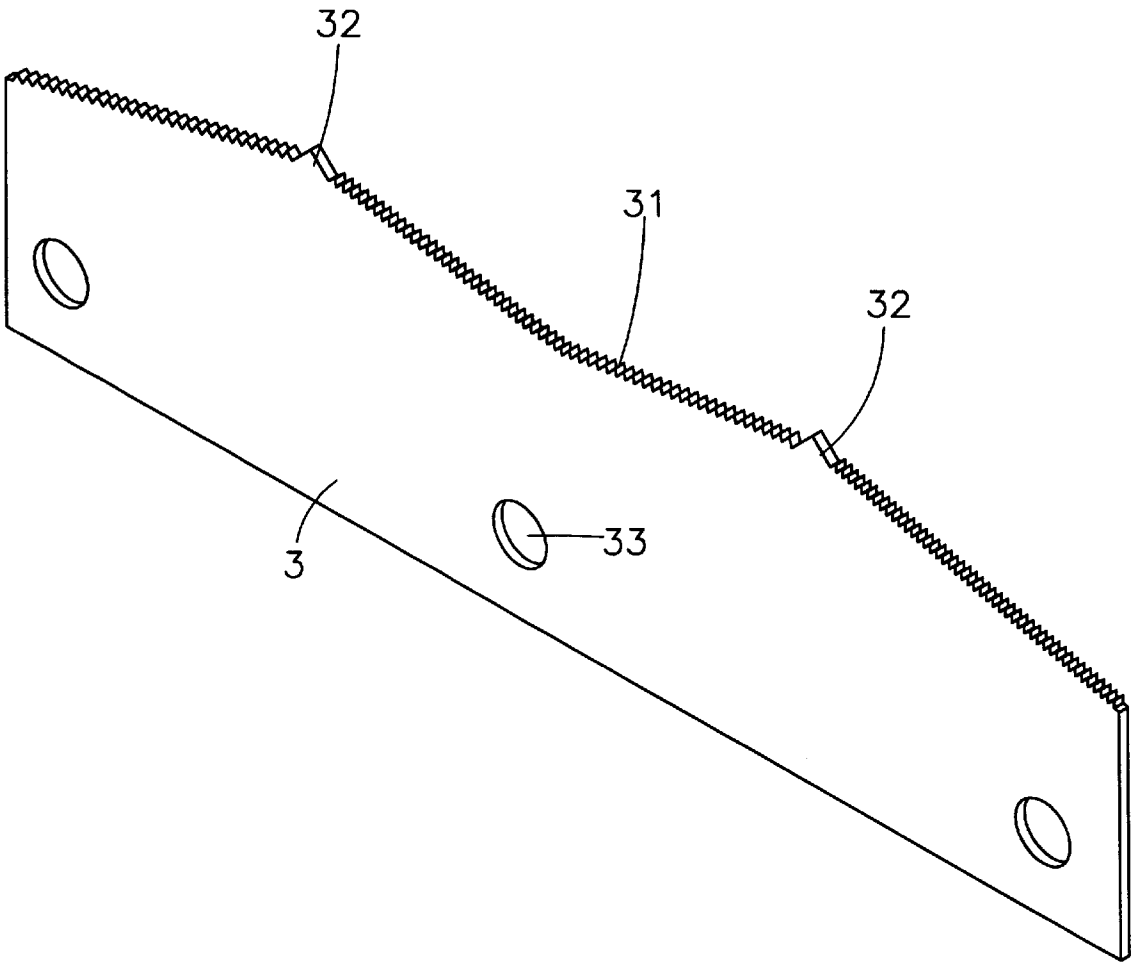
FIG. 3 is an elevational view in an enlarged scale of the serrated plate according to the present invention.
Figure 4:
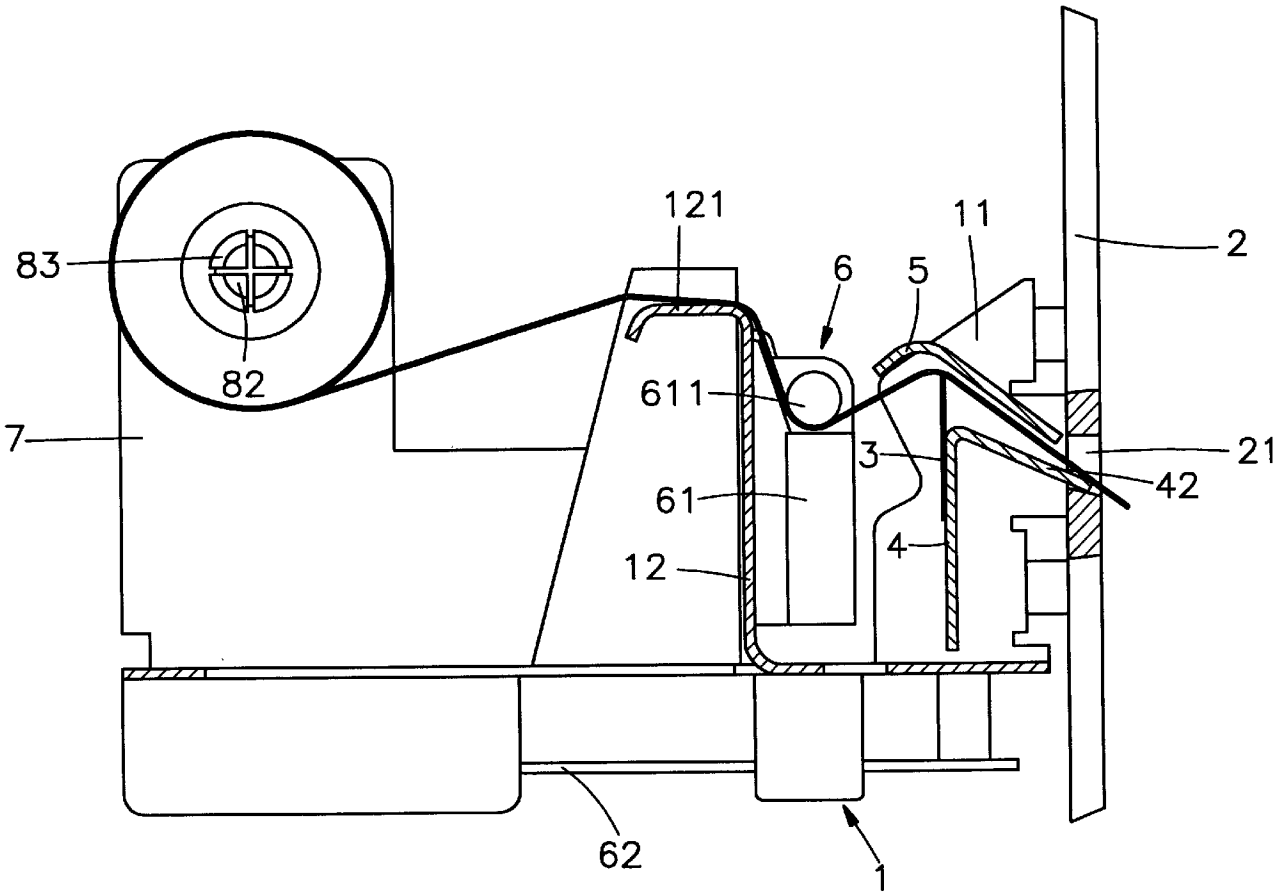
FIG. 4 is a side plain view of the lottery ticket machine according to the present invention.
Figure 5:
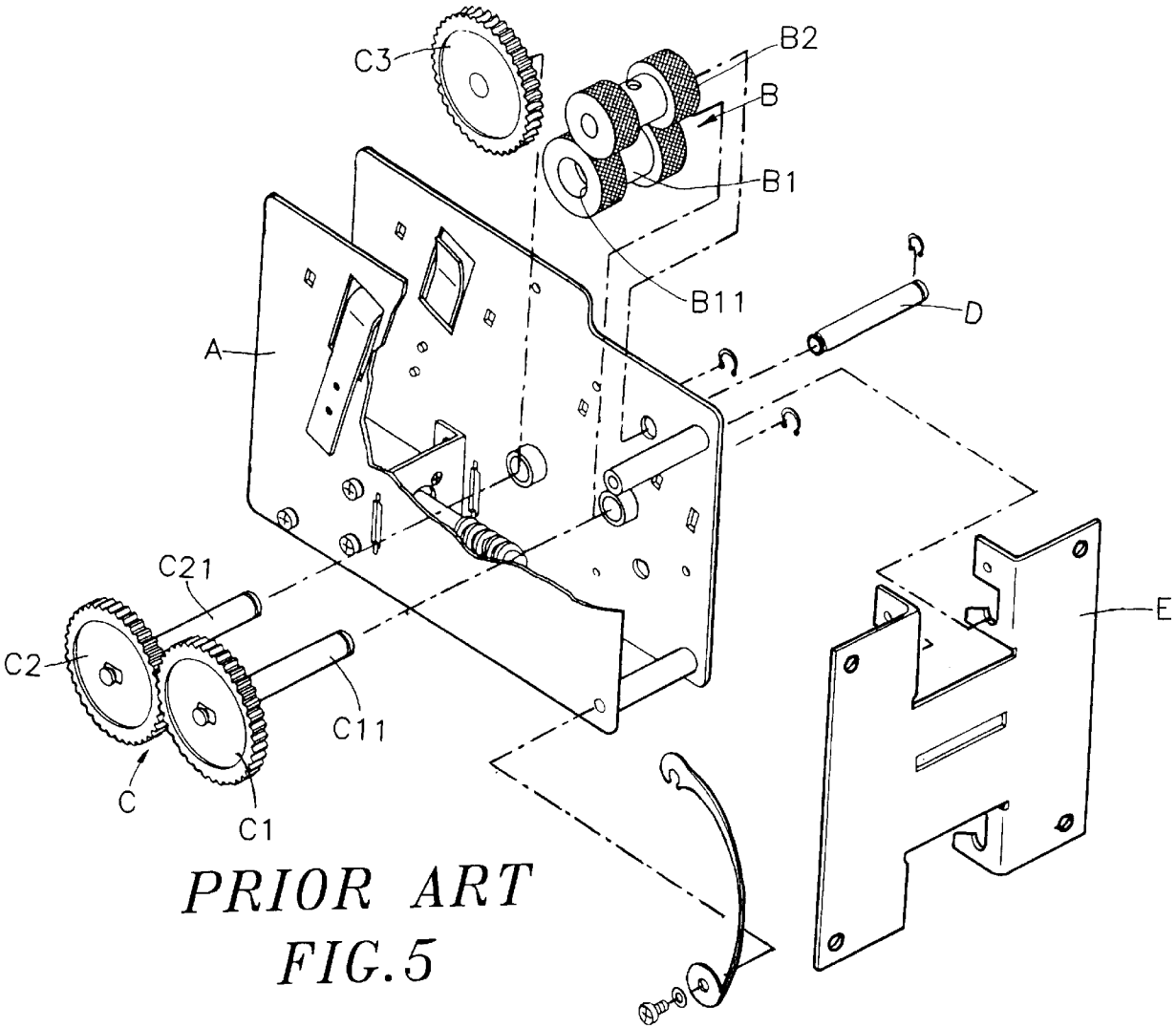
PRIOR ART FIG. 5
FIG. 5 is an exploded view of a lottery ticket machine according to the prior art.

Referring to FIGS. from 2 through 4 again, after a ticket reel had been mounted on the transverse rod 8, the lead end of the continuous sheet of lottery tickets is pulled from the ticket reel over the guide face 121 of the transverse wall 12 of the base frame 1, and then inserted through the gap between the serrated plate 3 and the pressure plate 5, and then extended over the guide face 42 of the rack 4 through the ticket slot 21 to the outside of the face panel 2. At this time, the perforation between the first two lottery tickets of the continuous sheet of lottery tickets is supported on the serrated edge 31 of the serrated plate 3 (see FIG. 3) between the protruded portions 32, and therefore the first lottery ticket can easily be separated from the continuous sheet of lottery tickets.

It is to be understood that the drawings are designed for purposes of illustration only, and are not intended for use as a definition of the limits and scope of the invention disclosed.

What the invention claimed is:

1. A lottery ticket machine comprising:

a base frame, said base frame comprising two upright supports disposed at two opposite lateral sides thereof, and a transverse wall vertically disposed on the middle;

a face panel fixedly fastened to the upright supports of said base frame at a front side, said face panel having a transversely extended ticket slot;

a rack connected between the upright supports of said base frame behind said face panel;

a serrated plate fixedly fastened to said rack at a topside below the elevation of the ticket slot of said face panel;

a pressure plate pivoted to said base frame between said upright supports and adapted to hold down a continuous sheet of lottery tickets on said serrated plate;

a locating plate fixedly fastened to one lateral side of said base frame near a rear side of base frame;

a transverse rod fastened to said locating plate and suspended behind the transverse wall of said base frame and adapted to hold a reel of a continuous sheet of lottery tickets; and a control circuit assembly installed in said base frame, said control circuit assembly comprising a control circuit board, a gear box mounted on the transverse wall of said base frame, a shaft suspended behind said serrated plate and adapted to transfer a continuous sheet of lottery tickets from the ticket reel at said transverse rod toward the ticket slot of said face panel, and a gear box controlled by said control circuit board to rotate said shaft;

wherein said serrated plate comprises a serrated edge of substantially M-shaped profile extended along one long side thereof and suspended above the topmost edge of said rack, and two protruded portions integral with said serrated edge and spaced from each other at a pitch approximately equal to the width of the continuous sheet of lottery tickets to be loaded on said transverse rod.

2. The lottery ticket machine of claim 1 wherein said serrated plate has a plurality of mounting holes respectively fastened to said rack by screws.

3. The lottery ticket machine of claim 2 wherein said rack has a sloping top guide face adapted to guide a continuous sheet of lottery tickets from said transverse rod toward the ticket slot of said face panel.

4. The lottery ticket machine of claim 1 wherein the upright supports of said base frame each comprise a plurality of transversely extended mounting flanges respectively fastened to said face panel.

5. The lottery ticket machine of claim 1 wherein said pressure plate comprises two locating flanges respectively extended from two distal ends thereof and respectively hooked on the upright supports of said base frame.

* * * * *